US007899199B2

(12) United States Patent
Menzl

(10) Patent No.: US 7,899,199 B2
(45) Date of Patent: Mar. 1, 2011

(54) HEARING DEVICE AND METHOD WITH A MUTE FUNCTION PROGRAM

(75) Inventor: Stefan Menzl, Jona (CH)

(73) Assignee: Phonak AG, Stafa (CH)

( * ) Notice: Subject to any disclaimer, the term of this patent is extended or adjusted under 35 U.S.C. 154(b) by 1427 days.

(21) Appl. No.: 11/292,205

(22) Filed: Dec. 1, 2005

(65) Prior Publication Data

US 2007/0127749 A1 Jun. 7, 2007

(51) Int. Cl.
*H04R 25/00* (2006.01)

(52) U.S. Cl. ..... 381/314; 381/312

(58) Field of Classification Search ..... 381/312, 381/314, 317, 318, 321
See application file for complete search history.

(56) References Cited

U.S. PATENT DOCUMENTS

| | | | | |
|---|---|---|---|---|
| 6,748,089 | B1 * | 6/2004 | Harris et al. | 381/312 |
| 6,910,013 | B2 | 6/2005 | Allegro et al. | |
| 7,319,768 | B2 * | 1/2008 | van Oerle | 381/312 |
| 2002/0037087 | A1 | 3/2002 | Allegro et al. | |
| 2003/0091197 | A1 | 5/2003 | Roeck et al. | |
| 2005/0074128 | A1 * | 4/2005 | Bachler | 381/317 |
| 2005/0207602 | A1 | 9/2005 | Van Oerle | |

FOREIGN PATENT DOCUMENTS

| | | | |
|---|---|---|---|
| EP | 0 732 036 | B1 | 5/1997 |
| EP | 0 814 636 | A1 | 12/1997 |
| EP | 1443801 | A2 | 8/2004 |

OTHER PUBLICATIONS

European Search Report, EP05026164, Oct. 30, 2006.

* cited by examiner

*Primary Examiner*—Brian Ensey
(74) *Attorney, Agent, or Firm*—Pearne & Gordon LLP

(57) ABSTRACT

A hearing device (1) and a method to operate a hearing device (1), the method comprising the steps of selecting a hearing program from a set of hearing programs, the set comprising at least two hearing programs, one of which is a mute hearing program being defined by applying no or only a reduced signal to a receiver of the hearing device (1), operating the hearing device (1) in the mute hearing program after it has been activated, monitoring an input signal to the hearing device (1), selecting another hearing program than the mute hearing program after a predefined activity has been detected in the input signal, and operating the hearing device (1) according to the selected hearing program.

16 Claims, 1 Drawing Sheet

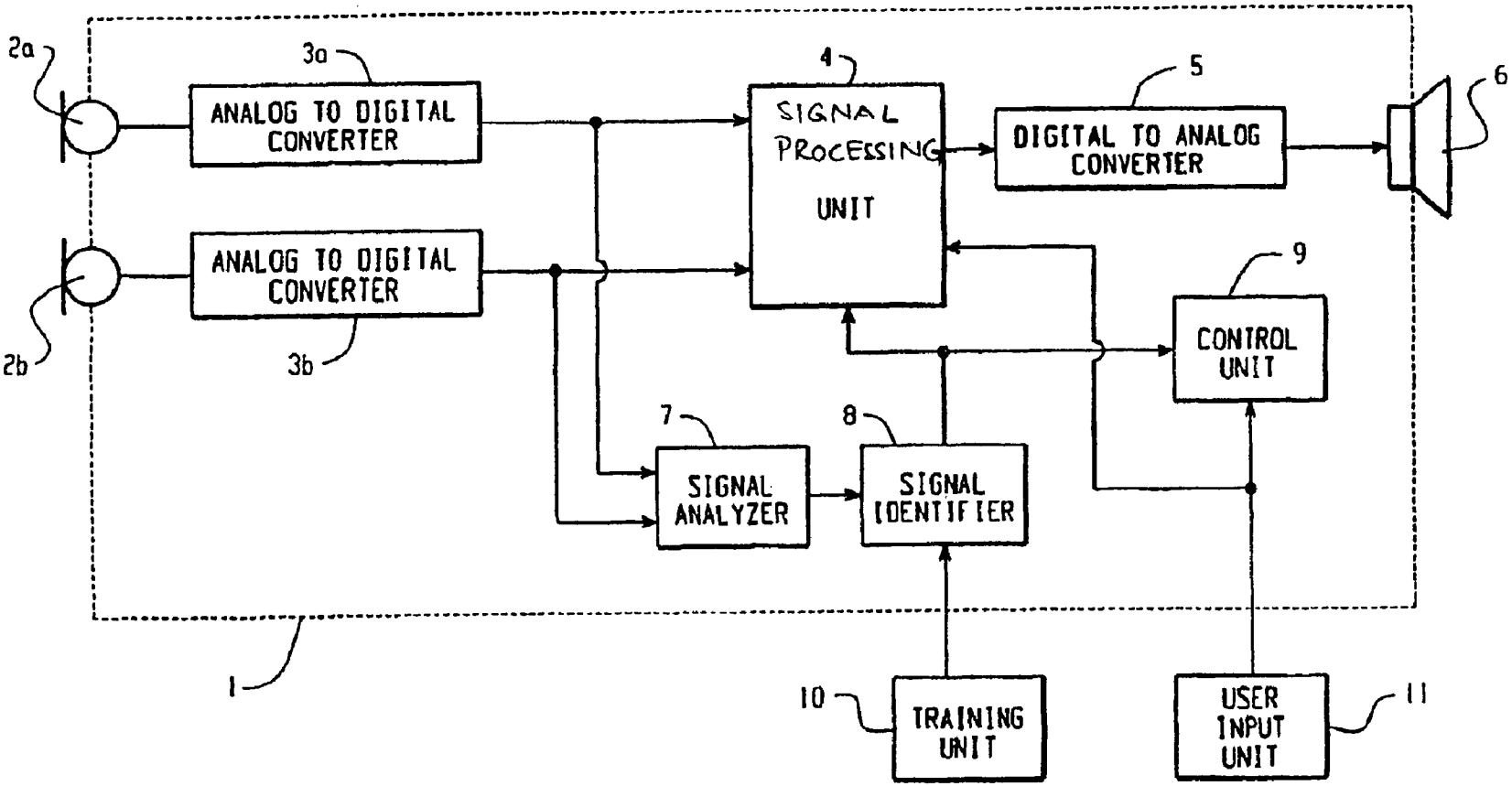
6
5
DIGITAL TO ANALOG CONVERTER
9
CONTROL UNIT
11
USER INPUT UNIT
4
SIGNAL PROCESSING UNIT
8
SIGNAL IDENTIFIER
10
TRAINING UNIT
7
SIGNAL ANALYZER
3a
ANALOG TO DIGITAL CONVERTER
3b
ANALOG TO DIGITAL CONVERTER
1
2a
2b

HEARING DEVICE AND METHOD WITH A MUTE FUNCTION PROGRAM

TECHNICAL FIELD

The present invention is related to a method to operate a hearing device, in particular to a method to operate a hearing device having a reduced operating mode, as well as to a hearing device.

BACKGROUND OF THE INVENTION

There have already been hearing devices on the market where the user can manually select a hearing program that is tailored to a specific acoustic surround situation. The selection can either be performed via a switch at the hearing device or via a remote control. There also exist hearing devices capable of automatically recognizing the momentary acoustic surround situation. In this connection, reference is made to the European patents EP-B1-0 732 036 and EP-A1-0 814 636 as well as to U.S. Pat. No. 6,910,013 B2.

In particular, the teaching of U.S. Pat. No. 6,910,013 B2 discloses a technique which is very reliable and has a high acceptance in the market. The known teaching makes use of statistical analysis of the momentary acoustic surround situation in that features are extracted in a first step, and classified in a subsequent step. In any event, the result of this known technique is the selection of the most suitable hearing program being fully activated.

In some cases however, the hearing device user does not want to be disturbed by an acoustic stimulation. Under such circumstances, the hearing device user very often removes the hearing device, or switches off the hearing device in order to create a quiet atmosphere. In case someone wants to speak with the hearing device user, this is not possible via an acoustic signal because the hearing device user may not hear it. Furthermore, an emergency situation may not be recognized by the hearing device user once the hearing device is switched off or removed from the ear.

It is therefore an object of the present invention to overcome the above-mentioned drawback und to further improve the known techniques.

SUMMARY OF THE INVENTION

The method according to the present invention comprises the following steps:

- selecting a hearing program from a set of hearing programs, the set comprising at least two hearing programs, one of which is a mute hearing program being defined by applying no or only a reduced signal to a receiver (i.e. loudspeaker) of the hearing device,
- operating the hearing device in the mute hearing program after it has been activated,
- monitoring an input signal to the hearing device,
- selecting another hearing program than the mute hearing program after a predefined activity has been detected in the input signal, and
- operating the hearing device according to another hearing program than the mute hearing program after selecting another hearing program.

A number of advantages are obtained there from. For example, the inventive method allows to automatically detecting a new acoustic surround situation, with which a hearing device user is confronted, even thought the hearing device is operated in the mute mode (mute hearing program) and, therefore, the hearing device user is presently not aware of the new acoustic surround situation. Only if the new acoustic surround situation meets one of the predefined activities, another hearing program than the mute hearing program is activated and the hearing device user becomes aware of the new acoustic surround situation. In other words, only specific predefined situations (i.e. activities), which can be defined and adjusted by the user in advance, result in an interruption of the mute hearing program. This is in particular important for any emergency situation. For such situations, it is mandatory that the hearing device user is immediately informed in order that he may take appropriate actions.

In another embodiment of the present invention, the mute hearing program is activated manually, preferably by the hearing device user. Yet, an automatic activation of the mute hearing program is also possible and in some circumstances an advantage.

In a particular embodiment of the present invention, the input signal is monitored according to the following steps:

- extracting characteristic features from the input signal;
- identifying an activity in the input signal on the basis of the extracted characteristic features.

Therewith, a highly sophisticated algorithm is applicable as, for example, described in U.S. Pat. No. 6,910,013 B2, which is herewith incorporated by reference in its entirety.

In a more specific embodiment of the present invention, the predefined activity might be one of the following, or, if more than one activity is predefined, a single activity can be a combination of several of the following, or several activities are predefined, each being defined according to one of the following:

- emergency signal;
- loud speech signal characterized by pitch and/or level;
- telephone signal;
- timer signal;
- door bell;
- predefined sound level;
- fast rising sound signal;
- fast changing frequency content of the signal;
- a signal received from a remote control adapted to communicate with the hearing device.

In general, any characterization can be used to predefine an activity that is used as a basis of the monitoring function during the monitoring process and that is used to select another hearing program than the mute hearing program.

In a more specific embodiment of the present invention, once the mute hearing program is active, the power consumption in the hearing device is reduced in that, for example, the receiver in the hearing device is switched off, the signal processing unit is clocked at a reduced clock rate, the sampling rate is reduced or the power supply voltage is reduced, to mention only a few possibilities. Of course, a combination of these and other possibilities is also feasible.

Besides a method to operate a hearing device, a hearing device is also disclosed having means to fulfill the method steps according to the present invention.

The present invention is further explained in more detail by way of example by referring to a drawing.

BRIEF DESCRIPTION OF THE DRAWING

The only FIGURE is a block diagram of a hearing device in which the method according to the invention has been implemented.

DETAILED DESCRIPTION OF THE INVENTION

In the only FIGURE, the reference number 1 designates a hearing device. For the purpose of the following description, the term "hearing device" is intended to include hearing devices, or hearing aids, as used to compensate a hearing impairment of a person, but also all other acoustic communication systems such as radio transceivers (walky-talky) or the like. Furthermore, the term "hearing device" not only includes BTE (Behind-the-ear), ITC (In-the-Canal) and CIC (Completely-in-the-Canal) but also implantable devices.

The hearing device 1 comprises, in conventional fashion, three electro-acoustic converters 2*a*, 2*b* and 6, these being two microphones 2*a*, 2*b* and a loudspeaker 6, also referred to as a receiver in the technical fields of hearing devices. It is pointed out that the present invention may also only have one microphone instead of two. A main component of the hearing device 1 is a signal processing unit 4, in which, in case of a hearing aid, signal modification takes place in adaptation to the requirements of the user of the hearing device 1. However, the operations performed in the signal processing unit 4 are not only a function of the nature of a specific purpose of the hearing device 1 but are also, and especially, a function of a momentary acoustic surround situation and the characteristics of the user's head, the location of the hearing device with respect to the head and finally the characteristics of the electro-acoustic elements (microphones, receiver).

In addition to the aforementioned components, such as microphones 2*a*, 2*b*, the signal processing unit 4 and the receiver 6, the hearing device 1 comprises a signal analyzer 7 and a signal identifier 8. If the hearing device 1 is based on digital technology, one or several analog-to-digital converters 3*a*, 3*b* are positioned in between the microphones 2*a*, 2*b* and the signal processing unit 4, and one digital-to-analog converter 5 is provided in between the signal processing unit 4 and the receiver 6. Note that the converters may be high resolution linear devices or highly non-linear detectors (such as a level detector with built-in averaging capabilities). While a digital implementation of the present invention is preferred, it is equally possible to use analog components throughout or a combination of analog and digital components. In this case, of course, the converters 3*a*, 3*b* and 5 might not be needed.

The signal analyzer 7 receives the same input signal as the signal processing unit 4. The signal identifier 8, which is connected to the output of the signal analyzer 7, connects at the other end of the signal processing unit 4 and to a control unit 9.

A training unit 10 serves to establish, in off-line operation, the parameters required in the signal identifier 8 for the classification process.

By means of a user input unit 11, the user can override the settings of the signal processing unit 4 and the control unit 9 as established by the signal analyzer 7 and the signal identifier 8. Specific settings of the signal processing unit 4 are also referred to by the term "hearing program".

Further information regarding specific functions of the hearing device, in particular regarding the automatic detection of a momentary acoustic surround situation in order to select the best possible hearing program can be taken from U.S. Pat. No. 6,910,013 B2, which is hereby incorporated by reference in its entirety.

As described above, the present invention discloses the possibility to activate a mute hearing program in the hearing device. This gives the hearing device user the possibility to shield off the acoustic outside world. In particular, the hearing device user can therewith create a quiet atmosphere in which he can concentrate on written matter, for example, without being acoustically disturbed.

The mute hearing program is characterized in that no or only a reduced signal is applied to the receiver 6. This does not mean that the whole hearing device is in a stand-by state, as it could commonly be understood. In contrast thereto, the term "mute hearing program" means that at least one of the microphones 2*a* and 2*b* is active, i.e. records the acoustic input signal to the hearing device, and that the signal processing unit 4 processing the acoustic input signal as well as any analog-to-digital converter 3*a*, 3*b* in-between the signal processing unit 4 and the microphones 2*a* and 2*b* are at least to some extend active in that a monitoring function to be further described can be performed. Note that the activity may be at a reduced level to save energy.

In other words, although the hearing device 1 is inactive from the point of view of the hearing device user, the internal components, in particular the signal processing unit 4 and the microphones 2*a* and 2*b* are active in that the input signal of the microphone 2*a*, 2*b* is processed in the signal processing unit 4. The processing of the input signal is at least a monitoring function with the aim to detect a predefined acoustic activity. As soon as such a predefined activity is detected the hearing device, or its signal processing unit 4, switches to another hearing program, preferably to a hearing program that is most suitable to handle the momentary acoustic surround situation. As soon as such an automatically initiated hearing program change occurs, the hearing device user is again exposed to the acoustic situation and can take an appropriate action. In general, as soon as a predefined activity is detected, a hearing program other than the mute hearing program is automatically selected in the hearing device. A soft fade-in may be required to avoid the user being shocked.

Instead of selecting the most suitable hearing program for the momentary acoustic surround situation, it is feasible in a further embodiment of the present invention to always switch to a predefined hearing program irrespectively of the momentary acoustic surround situation.

As has been pointed out, the presence of a predefined activity is necessary or must have been detected to initiate a hearing program change from the mute hearing program to another hearing program. A predefined activity can arbitrarily be defined and tailored to the specific needs of the hearing device user also taking into account a specific hearing disability, for example. The activity may be tailored to the needs of the user during the fitting process.

A predefined activity can be, for example, one of the following:

- an emergency signal described by a certain sequence of sounds at given frequencies;
- a loud speech signal characterized by corresponding pitch and/or level;
- timer signal, kitchen clock, emergency signal, door bell or telephone signal (also individualized telephone signals), again described by the defined sequence of a general ring signal or defined by a specific signal for a proper identification;
- predefined sound level;
- fast rising sound signal;
- fast changes of the statistics (mean level, frequency components, mean center frequency, strong pitch) of the input signal;
- a signal received from a remote control adapted to communicate with the hearing device.

As for the detection of a speech signal, the monitoring can be adapted to detect a certain person only, for example, or to detect only new speakers speaking at a predefined loudness level.

As can be seen from the above-mentioned examples, the variety for defining the predefined activities is very large.

In yet another embodiment of the present invention, the predefined activity is adapted to a changing or changed situation. In other words, a learning algorithm is applied to adapt an activity or some or all activities continually.

In yet another embodiment of the present invention, the hearing device, for which the mute hearing program is active, is operated in a reduced power consumption mode in order to save energy and thus prolong battery life. The reduced power consumption mode does not completely shut down the processing of the input signal but may reduce the processing speed in the signal processing unit 4 or it may decimate the signal, by reducing the sampling rate, and only process a certain percentage of the signal. For example, the clock rate and/or the supply voltage for the signal processing unit 4 and for any other components can be reduced. The reduction is limited to the minimal processing power that is necessary to fulfill the above-mentioned tasks.

In a further embodiment of the present invention, a highly sophisticated algorithm is used to detect a momentary acoustic surround situation which is the basis of the monitoring function and the detection of the predefined activity. Such an algorithm is disclosed in U.S. Pat. No. 6,910,013 B2 of the same applicant.

In a further embodiment, the feature extraction performed by other resident signal processing algorithms (such as noise canceller, feedback canceller, classifier, etc.) is reused to analyze the acoustic surround situation.

Having thus shown and described what is at present considered to be the exemplified embodiments of the invention, it should be noted that the same has been made by way of illustration and not limitation. Accordingly, all modifications, alterations and changes coming within the spirit and scope of the invention are herein meant to be included.

The invention claimed is:

1. A method to operate a hearing device, the method comprising the steps of:

selecting a hearing program from a set of hearing programs, the set comprising at least two hearing programs, one of which is a mute hearing program being defined by applying no or only a reduced signal to a receiver of the hearing device, operating the hearing device in the mute hearing program after it has been activated, monitoring an input signal to the hearing device, selecting another hearing program than the mute hearing program after a predefined activity defined for changing from the mute hearing program has been detected in the input signal, and operating the hearing device according to the selected hearing program.

2. The method of claim 1, further comprising the step of manually activating the mute hearing program.

3. A method to operate a hearing device, the method comprising the steps of:

selecting a hearing program from a set of hearing programs, the set comprising at least two hearing programs, one of which is a mute hearing program being defined by applying no or only a reduced signal to a receiver of the hearing device, operating the hearing device in the mute hearing program after it has been activated, monitoring an input signal to the hearing device, wherein the step of monitoring the input signal is performed according to the following steps:

extracting characteristic features from the input signal; and identifying an activity in the input signal on the basis of the extracted characteristic features;

selecting another hearing program than the mute hearing program after a predefined activity has been detected in the input signal, and operating the hearing device according to the selected hearing program.

4. The method of claim 1, wherein the predefined activity is one or a combination of several of the following activities:

emergency signal;

loud speech signal characterized by at least one of pitch or level;

telephone signal;

timer signal;

door bell;

predefined sound level;

fast rising sound signal;

fast changing frequency content of the signal; or a signal received from a remote control adapted to communicate with the hearing device.

5. A method to operate a hearing device, the method comprising the steps of:

selecting a hearing program from a set of hearing programs, the set comprising at least two hearing programs, one of which is a mute hearing program being defined by applying no or only a reduced signal to a receiver of the hearing device, operating the hearing device in the mute hearing program after it has been activated, characterized by operating the hearing device at a reduced power consumption level while the mute hearing program is active, monitoring an input signal to the hearing device, selecting another hearing program than the mute hearing program after a predefined activity has been detected in the input signal, and operating the hearing device according to the selected hearing program.

6. A hearing device comprising:

at least one microphone generating an input signal, a signal processing unit, a receiver, means for selecting a hearing program from a set of hearing programs, the set comprising at least two hearing programs, one of which is a mute hearing program being defined by applying no or only a reduced signal to the receiver, means for operating the hearing device in the mute hearing program after it has been activated, means for monitoring the input signal or its statistics, means for selecting another hearing program than the mute hearing program after a predefined activity defined for changing from the mute hearing program has been detected in the input signal, and means for operating the hearing device according to the selected hearing program, wherein the at least one microphone being operationally connected to the receiver via the signal processing unit.

7. The hearing device of claim 6, further comprising means for manually activating the mute hearing program.

8. A hearing device comprising:

at least one microphone generating an input signal, a signal processing unit, a receiver, means for selecting a hearing program from a set of hearing programs, the set comprising at least two hearing programs one of which is a mute hearing program being defined by applying no or only a reduced signal to the receiver, means for operating the hearing device in the mute hearing program after it has been activated, means for monitoring the input signal or its statistics, wherein the means for monitoring the input signal comprise:

means for extracting characteristic features from the input signal; and means for identifying an activity in the input signal on the basis of the extracted characteristic features;

means for selecting another hearing program than the mute hearing program after a predefined activity has been detected in the input signal, and means for operating the hearing device according to the selected hearing program, wherein the at least one microphone being operationally connected to the receiver via the signal processing unit.

9. The hearing device of claim 6, wherein the predefined activity is one or a combination of several of the following activities:

emergency signal;

loud speech signal characterized by at least one of pitch or level;

telephone signal;

timer signal;

door bell;

predefined sound level;

fast rising sound signal;

fast changing frequency content of the signal; or a signal received from a remote control adapted to communicate with the hearing device.

10. A hearing device comprising:

at least one microphone generating an input signal, a signal processing unit, a receiver, means for selecting a hearing program from a set of hearing programs, the set comprising at least two hearing programs, one of which is a mute hearing program being defined by applying no or only a reduced signal to the receiver, means for operating the hearing device in the mute hearing program after it has been activated, characterized by means for operating the hearing device at a reduced power consumption level while the mute hearing program is active, means for monitoring the input signal or its statistics, means for selecting another hearing program than the mute hearing program after a predefined activity has been detected in the input signal, and means for operating the hearing device according to the selected hearing program, wherein the at least one microphone being operationally connected to the receiver via the signal processing unit.

11. The method of claim 5, further comprising the step of manually activating the mute hearing program.

12. The method of claim 5, wherein the step of monitoring the input signal is performed according to the following steps:

extracting characteristic features from the input signal; and identifying an activity in the input signal on the basis of the extracted characteristic features.

13. The method of claim 5, wherein the predefined activity is one or a combination of several of the following activities:

emergency signal;

loud speech signal characterized by at least one of pitch or level;

telephone signal;

timer signal;

door bell;

predefined sound level;

fast rising sound signal;

fast changing frequency content of the signal; or a signal received from a remote control adapted to communicate with the hearing device.

14. The hearing device of claim 10, further comprising means for manually activating the mute hearing program.

15. The hearing device of claim 10, wherein the means for monitoring the input signal comprise:

means for extracting characteristic features from the input signal; and means for identifying an activity in the input signal on the basis of the extracted characteristic features.

16. The hearing device of claim 10, wherein the predefined activity is one or a combination of several of the following activities:

emergency signal;

loud speech signal characterized by at least one of pitch or level;

telephone signal;

timer signal;

door bell;

predefined sound level;

fast rising sound signal;

fast changing frequency content of the signal; or a signal received from a remote control adapted to communicate with the hearing device.

* * * * *